US008220645B2

(12) United States Patent
Robinson

(10) Patent No.: US 8,220,645 B2
(45) Date of Patent: Jul. 17, 2012

(54) DESK ORGANIZER DEVICE

(76) Inventor: Henry Robinson, Rialto, CA (US)

( * ) Notice: Subject to any disclaimer, the term of this patent is extended or adjusted under 35 U.S.C. 154(b) by 280 days.

(21) Appl. No.: 12/221,275

(22) Filed: Aug. 1, 2008

(65) Prior Publication Data

US 2009/0032479 A1 Feb. 5, 2009

Related U.S. Application Data

(60) Provisional application No. 60/953,840, filed on Aug. 3, 2007.

(51) Int. Cl.
*B42F 17/00* (2006.01)
*B65D 85/28* (2006.01)

(52) U.S. Cl. ..... 211/11; 312/330.1; 206/224; 206/371

(58) Field of Classification Search ..... 211/1.51, 211/10, 11, 13.1, 45, 46, 50, 65, 69.1, 114, 211/126.1, 126.13; 312/114, 285, 330.1; 206/214, 224, 371, 411, 557, 561, 562, 563, 206/565

See application file for complete search history.

(56) References Cited

U.S. PATENT DOCUMENTS

| | | | | | |
|---|---|---|---|---|---|
| 83,884 | A | * | 11/1868 | Squrman | 211/65 |
| 181,449 | A | * | 8/1876 | Keys et al. | 312/305 |
| 225,846 | A | * | 3/1880 | Martin | 312/59 |
| 892,969 | A | * | 7/1908 | Wilson | 220/524 |
| 1,131,713 | A | * | 3/1915 | Kramer | 312/210 |
| 3,327,688 | A | * | 6/1967 | Smith | 206/214 |
| 3,460,899 | A | * | 8/1969 | Miller | 422/300 |
| 3,481,452 | A | * | 12/1969 | Pickios | 206/224 |
| 4,406,368 | A | * | 9/1983 | Hermes | 206/371 |
| 4,512,503 | A | * | 4/1985 | Gioso | 224/539 |
| D285,392 | S | * | 9/1986 | Thompson | D6/399 |
| 4,619,386 | A | * | 10/1986 | Richardson | 224/277 |
| 4,654,762 | A | * | 3/1987 | Laverick | 362/97.1 |
| 4,700,829 | A | * | 10/1987 | Goodyear | 206/214 |
| 4,740,044 | A | | 4/1988 | Taylor | |
| D295,540 | S | * | 5/1988 | Rabig | D19/92 |
| D298,953 | S | * | 12/1988 | Roberts | D19/78 |
| 4,919,276 | A | * | 4/1990 | Kim et al. | 211/126.14 |
| 4,934,527 | A | * | 6/1990 | Ho | 206/224 |
| 4,953,696 | A | * | 9/1990 | Huang et al. | 206/214 |
| 5,134,918 | A | * | 8/1992 | Chang | 84/600 |
| 5,219,446 | A | * | 6/1993 | Klepac | 362/154 |
| D341,375 | S | * | 11/1993 | Chin | D19/75 |
| D353,905 | S | * | 12/1994 | Lin | D26/65 |
| D367,124 | S | * | 2/1996 | Sherman | D26/63 |
| D372,938 | S | * | 8/1996 | Wilson et al. | D19/75 |
| 5,775,521 | A | | 7/1998 | Tisbo | |
| 5,790,477 | A | * | 8/1998 | Hauke | 368/10 |
| 6,092,672 | A | | 7/2000 | Harris et al. | |
| 6,279,753 | B1 | * | 8/2001 | Swanson | 211/13.1 |
| 7,204,376 | B2 | * | 4/2007 | Richardson et al. | 211/189 |
| 2002/0104811 | A1 | * | 8/2002 | Young et al. | 211/13.1 |
| 2005/0082198 | A1 | * | 4/2005 | Batis | 206/575 |
| 2006/0011564 | A1 | * | 1/2006 | Hatzis | 211/10 |

* cited by examiner

*Primary Examiner* — Darnell Jayne
*Assistant Examiner* — Joshua Rodden
(74) *Attorney, Agent, or Firm* — James Ray and Associates, LLC.

(57) ABSTRACT

A desk organizer device having a housing member disposed on a substantially hollow base member having open front and back ends. A plurality of compartments disposed on and within the housing member for storing a plurality of items. An electric pencil sharpener, a digital touch screen, a tape dispenser, and at least one of cork board, foam material, and apertures for holding items being located on the housing member.

6 Claims, 3 Drawing Sheets

DESK ORGANIZER DEVICE

CROSS REFERENCE TO RELATED APPLICATION

This patent application is related to and claims priority from U.S. Provisional Patent Application Ser. No. 60/953,840 filed Aug. 3, 2007.

FIELD OF THE INVENTION

The present invention relates, in general, to desk organizers.

BACKGROUND OF THE INVENTION

Prior to the conception and development of the present invention, as is generally well known in the prior art, desktop organizers have been used by individuals to neaten the appearance of desks and to attempt to organize office supplies and necessities.

Specifically of interest to the present invention are the following: Harris, et al, U.S. Pat. No. 6,092,672, discloses a modular desktop assembly including a base and a plurality of modules including a vertical file releasably attached to and supported by the base and a cap releasably attached to the last to be stacked module.

Taylor, U.S. Pat. No. 4,740,044, discloses a vertically movable desk organizer unit mounted at the front end of a desk having pivotable trays and bins. A compartmentalized storage center may be raised and lowered and has rotatable, coverable trays, tiltable bins, and other receptacles for office stationary. When the organizer is in the raised position, the trays and bins pivot towards the desk surface; when the unit is being lowered to a position flush with the desk surface, the trays and bins are vertically pivoted, thereby requiring a minimum of depth requirement for the unit beyond the end of the desk.

Tisbo, U.S. Pat. No. 5,775,521, discloses an office organizational apparatus constructed of interlocking slat wall sections. Each individual slat is T-shaped for receiving one or more hooks incorporated on the mounting side of organizational accessories. These accessories are removably placed on the slatwall as needed and positioned upon consumer preference. The apparatus also includes a wire chase assembly attached to the bottom of the slat wall sections for receiving and organizing wires running along the desk. The slat wall sections and chase are encompassed in a frame structure which is supported by vertical members attached to the edge of a desk via clamps or directly to a wall.

SUMMARY OF THE INVENTION

The present invention provides a desk organizer device. Such desk organizer device includes a housing member manufactured from a first predetermined material and having a first predetermined shape and a first predetermined size. At least one compartment is disposed at least one of within and on such housing member at a predetermined location for at least one of receiving and storing at least one predetermined item. Such at least one compartment is at least one of a second predetermined size and a plurality of predetermined sizes. Such at least one compartment is at least one of a second predetermined shape and a plurality of predetermined shapes.

According to another embodiment, a combination lamp and desk organizer is provided. Such combination lamp and desk organizer includes a lamp member. Such lamp member is manufactured from a first predetermined material and has a first predetermined shape and a first predetermined size. A base member is operably connected to such lamp member at a predetermined location thereon. Such base member is manufactured from a second predetermined material and has a second predetermined size and a second predetermined shape. Such base member includes a housing member disposed on such base member at a predetermined location thereon. Such housing member is manufactured from a third predetermined material and has a third predetermined shape and a third predetermined size. At least one compartment is disposed at least one of within and on such housing member at a predetermined location for at least one of receiving and storing at least one predetermined item. Such at least one compartment is at least one of a fourth predetermined size and a plurality of predetermined sizes and such at least one compartment is at least one of a fourth predetermined shape and a plurality of predetermined shapes. A power source is operably disposed at least one of on and within at least one of such base member, such housing member, and a combination thereof for supplying power to such lamp member such that such lamp member may be selectively illuminated.

OBJECTS OF THE INVENTION

It is, therefore, one of the primary objects of the present invention to provide a desk organizer which will enable a user to keep all essential office supplies in one place.

Another object of the present invention is to provide a desk organizer which will enable a user to enjoy a clutter free desk.

Still another object of the present invention is to provide a desk organizer which includes an electric pencil sharpener.

Yet another object of the present invention is to provide a desk organizer which includes a digital rolodex, digital clock/calendar, a touchscreen, and/or other electronic items.

An additional object of the present invention is to provide a desk organizer having a circular shape for sitting upright on a desk and having pullout drawers.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
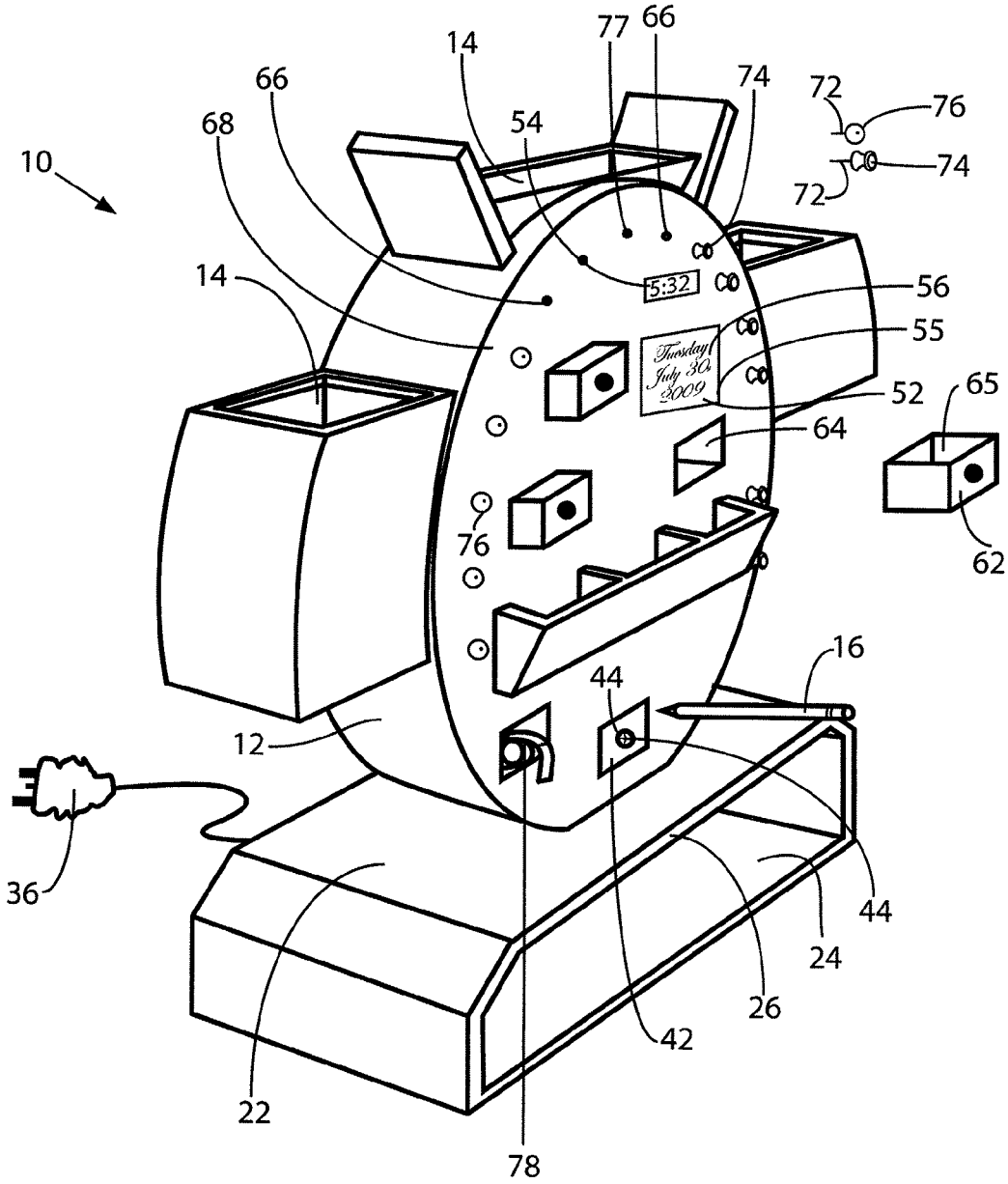
FIG. 1 is a partial perspective view of the invention according to one embodiment of the invention.
Figure 2:
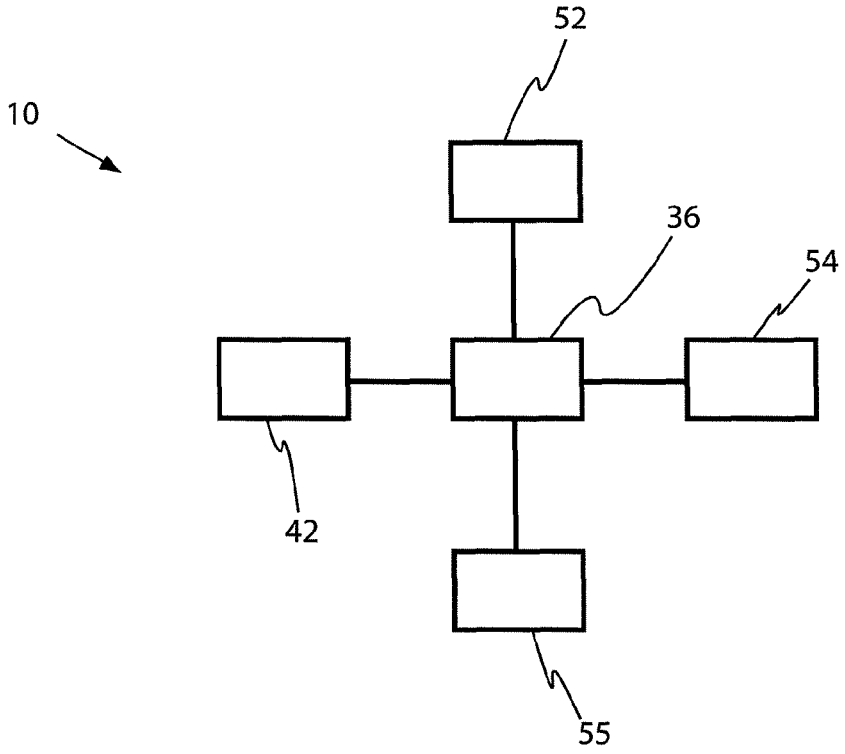
FIG. 2 is a partial schematic view of the invention according to one embodiment of the invention.
Figure 3:
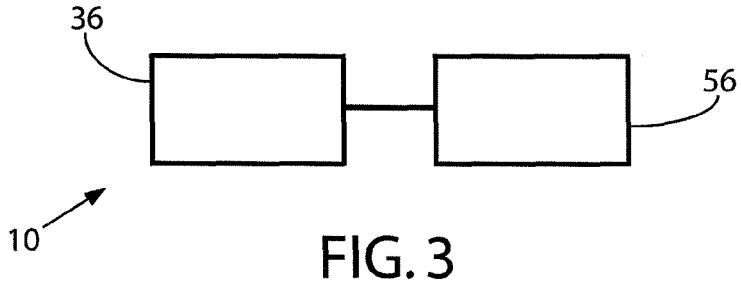
FIG. 3 is a partial schematic view of the invention according to one embodiment of the invention.
Figure 5:
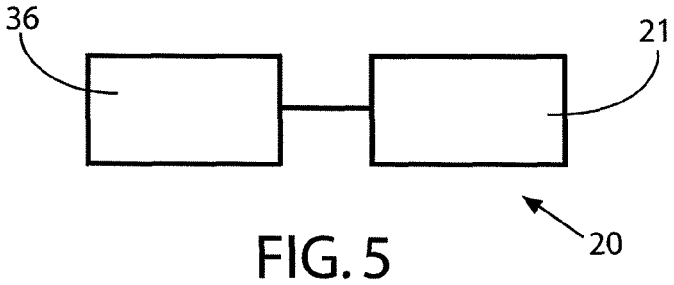
FIG. 5 is a partial schematic view of the invention according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-5.

A desk organizer device 10 includes a housing member 12 manufactured from a first predetermined material and having a first predetermined size and a first predetermined shape.

It is presently preferred that such first predetermined material is at least one of plastic and metal.

It is presently preferred that such first predetermined shape is generally circular. It is meant that such circular shape is similar to the face of a clock and is standing upright. However, the device 10 is not meant to be limited as such and any shape which reasonably facilitates the purpose of the housing member 12 may implemented.

At least one compartment 14 is disposed at least one of within and on such housing member 12 at a predetermined location for at least one of receiving and storing at least one predetermined item 16. Such at least one compartment 14 is at least one of a second predetermined size and a plurality of predetermined sizes. Such at least one compartment 14 is at least one of a second predetermined shape and a plurality of predetermined shapes. It is meant that compartments of different shapes and sizes may be disposed at least one of on and within such housing member 12 such that various articles may be stored within such compartments.

It is presently preferred that such predetermined sizes and shapes are sized and shaped for receiving at least one of a pair of scissors, paperclips, binder clips, a calculator, push pins, correction fluid, a letter opener, a screen cleaner, a tape dispenser, an adhesive type note pad, a rolodex, a clock, a calendar, a stapler, a staple remover, staples, envelopes, safety pins, pens, pencils, highlighters, erasers, markers, a notepad, and a combination thereof. The device 10 is meant to be an organizer and a storage device and housing for not only the aforementioned items but any other items which a user might desire to store in such device 10.

It is presently preferred that such desk organizer device 10 further includes a substantially hollow base member 22 with spaced-apart top and bottom planar portions creating open front and back portions, and is disposed on such housing member 12 such that such housing member 12 is at least one of supported, elevated, and a combination thereof. Such base member 22 is manufactured from a third predetermined material and has a third predetermined size and a third predetermined shape.

Figure 4:
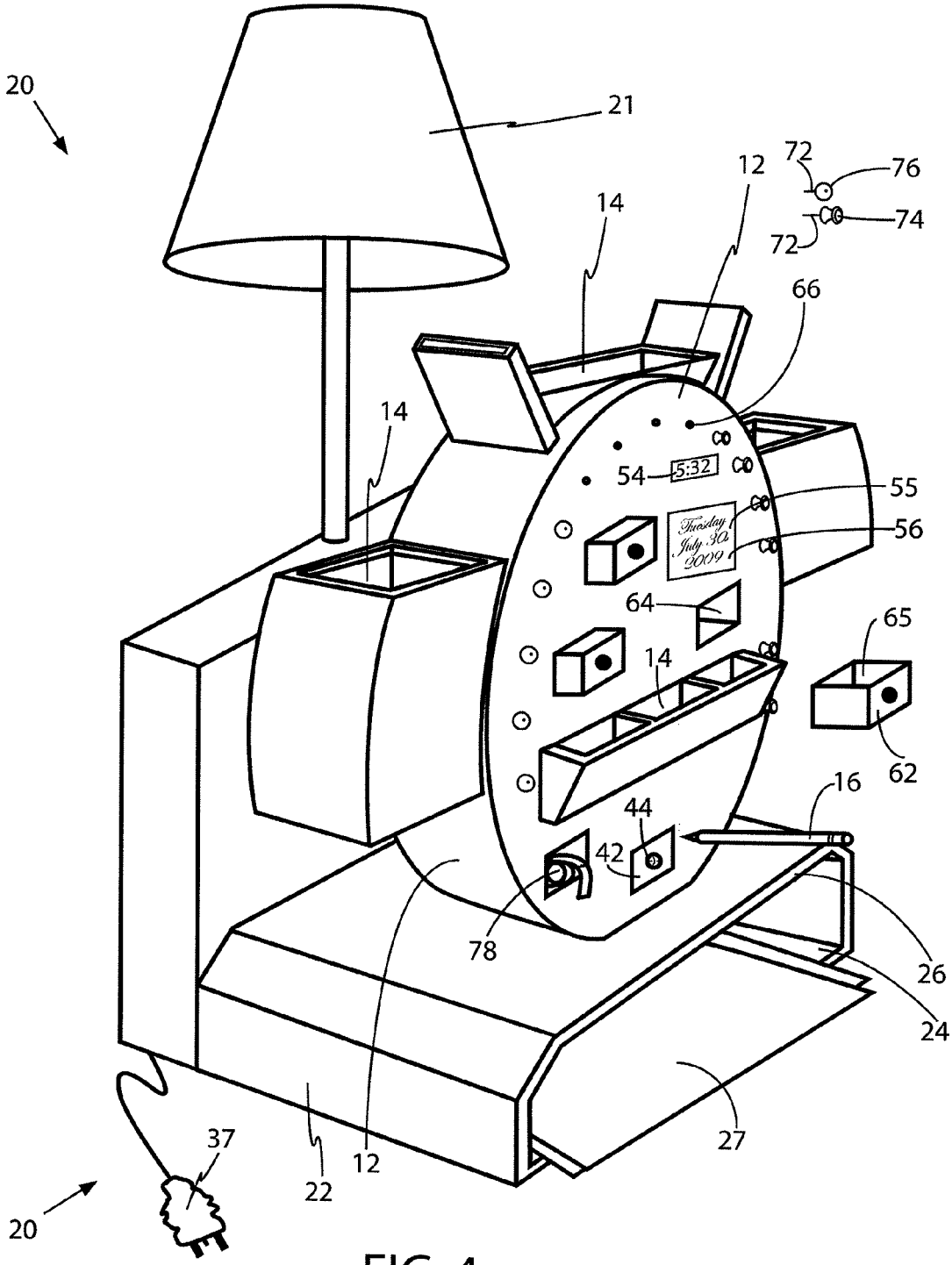
FIG. 4 is a partial perspective view of the invention according to one embodiment of the invention.

It is presently preferred that such base member 22 includes an opening 24 disposed on at least one of a front portion 26 thereof, a back portion (not shown) thereof, and a combination thereof for receiving at least one of files, papers, documents, folders, and a combination thereof. In FIG. 4, papers 27 are shown fitting neatly under the base member 22 thereby enabling a user to free valuable space on his or her desk. Such opening may extend through such base member 22 from such front portion 26 through such back portion.

It is presently preferred that such device 10 further includes a power source 36 operably disposed at least one of on and within at least one of such housing member 12 and such base member 22.

It is presently preferred that such power source 36 is at least one of AC and DC power.

It is meant that such device 10 may be powered by plugging an electrical cord 37 attached to such device 10 into a power outlet and/or by battery power.

It is presently preferred that such device 10 further includes a pencil sharpener 42 operably disposed at least one of on and within such housing member 12 such that a pencil receiving portion 44 of such pencil sharpener 42 is accessible to a user such that such user may thereby sharpen a pencil 16. The device 10 is not meant to be limited, however, and it is meant that user shall also be able to access such pencil sharpener to retrieve and dispose of pencil shavings and to repair or replace such pencil sharpener if necessary.

It is presently most preferred that such pencil sharpener 42 is an electric pencil sharpener 42 and is operably connected to such power source 36 for receiving power therefrom. However, the device 10 is not meant to be limited as such and any electric office apparatus including, but not limited to such electric pencil sharpener 42, is meant to be able to be implemented at least one of therein and thereon and to be operably connectable to such power source 36. For example, an electric stapler and electric scissors and the like may be part of the device 10 if desired. Such items may be integrated into the device 10 and items which are removable from such device 10 such as electric scissors are meant to be able to be charged from such power source 36. Furthermore, it is also contemplated that such housing member 12 may include a lamp member and/or the means to connect a lamp member into such housing member 12 and to such power source 36 for selectively lighting a predetermined area closely adjacent such device 10.

It is presently preferred that such desk organizer device 10 further includes at least one of a digital rolodex 52, a digital clock 54, a digital calendar 55, and a combination thereof disposed at least one of on and within such housing member 12 and operably connected to such power source 36 for receiving power therefrom. Other digital functions may also be included.

It is presently preferred that such desk organizer device 10 further includes an LCD touchscreen 56 operably connected to such power source 36 and disposed on such housing member 12 at a predetermined location thereon for accessing such at least one of such digital rolodex 52, such digital clock 54, such digital calendar 55, and such combination thereof. Such LCD touchscreen 56 may serve to access other digital functions as well.

It is further presently preferred that such desk organizer device 10 further includes at least one drawer member 62. Such at least one drawer member 62 is slidably connected to such housing member 12 at a predetermined location such that such drawer member 62 may extend to a position outside of an interior portion 64 of such housing member 12, thereby enabling a user to access an interior portion 65 of such at least one drawer member 62, and to retract to a position within such interior portion 64 of such housing member 12 for storage. Such at least one drawer member 62 is manufactured from a third predetermined material and has a third predetermined size and a third predetermined shape.

It is presently preferred that such housing member 12 further includes a means 66 disposed on a first surface 68 thereof for receiving a pin portion 72 of each of at least one of a plurality of thumb tacks 74 and a plurality of push pins 76 and for thereby storing such at least one of such plurality of push pins 76 and such plurality of thumb tacks 74. It is presently preferred that such means 66 is at least one of a plurality of apertures, corkboard, gypsum board, a foam type material, and a bulletin board type material. It is presently most preferred that such means 66 is a plurality of apertures 77.

It is presently preferred that such housing member 12 further includes a tape dispenser 78 operably disposed at a predetermined location thereon.

According to another embodiment, a combination lamp and desk organizer, generally designated 20, is provided.

Such combination lamp and desk organizer 20 includes a lamp member 21. Such lamp member 21 is manufactured from a first predetermined material and has a first predetermined shape and a first predetermined size.

A base member 22 is operably connected to such lamp member 21 at a predetermined location thereon. Such base member 22 is manufactured from a second predetermined material and has a second predetermined size and a second predetermined shape. Such base member 22 includes a housing member 12 disposed on such base member 22 at a predetermined location thereon. Such housing member 12 is manufactured from a third predetermined material and has a third predetermined shape and a third predetermined size.

At least one compartment 14 is disposed at least one of within and on such housing member 12 at a predetermined location for at least one of receiving and storing at least one predetermined item 16. Such at least one compartment 14 is at least one of a fourth predetermined size and a plurality of predetermined sizes and such at least one compartment 14 is at least one of a fourth predetermined shape and a plurality of predetermined shapes.

A power source 36 is operably disposed at least one of on and within at least one of such base member 22, such housing member 12, and a combination thereof for supplying power to such lamp member 21 such that such lamp member 21 may be selectively illuminated. It is presently preferred that such power source 36 is at least one of AC and DC power.

It is presently preferred that such housing member 12 is disposed on such base member 22 such that such housing member 12 is at least one of supported, elevated, and a combination thereof.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A desk organizer device comprising:

a) a housing member manufactured from a first predetermined material and having a first predetermined shape and a first predetermined size, wherein said first predetermined shape is substantially circular and includes a substantially vertical and planar front surface when said device is in use;

b) a power source operably disposed on said housing member;

c) an electric pencil sharpener mounted within said housing, said electric pencil sharpener accessible through said substantially vertical front surface and operably connected to said power source for receiving power therefrom;

d) a means disposed on said substantially vertical front surface for receiving a pin portion of each of at least one of a plurality of thumb tacks and a plurality of push pins and for thereby storing each of said at least one of said plurality of push pins and said plurality of thumb tacks;

e) at least two compartments disposed at least one of within and on said housing member at a predetermined location for at least one of receiving and storing at least two predetermined items, said at least two compartments being one of a second predetermined size and a plurality of predetermined sizes, respectively, and said at least two compartments being one of a second predetermined shape and a plurality of predetermined shapes, respectively; and f) a substantially hollow base member having spaced-apart top and bottom planar portions forming open front and back portions, said housing member disposed on said base member such that said housing member is supported and elevated above said base member during use.

2. The desk organizer device of claim 1, wherein said at least two compartments includes a pair of compartments disposed in a spaced apart relationship with each other on a peripheral side surface of said housing, each of said pair of compartments having an open top when said housing member is supported for use on said substantially hollow base member.

3. The desk organizer device according to claim 1 wherein said means is at least one of corkboard, and a foam material.

4. The desk organizer device according to claim 1 wherein said housing member further includes a tape dispenser operably disposed at a predetermined location thereon.

5. The desk organizer device according to claim 1 wherein said first predetermined material is one of plastic and metal.

6. A desk organizer device consisting of:

a) a housing member including a substantially planar front surface disposed substantially vertically when said device is in use and having a substantially circular shape;

b) a power source operably disposed on said housing member;

c) an electric pencil sharpener mounted within said housing, said electric pencil sharpener accessible through said substantially vertical front surface and operably connected to said power source for receiving power therefrom;

d) at least one of corkboard and a foam material disposed on said substantially vertical front surface for receiving a pin portion of each of at least one of a plurality of thumb tacks and a plurality of push pins and for thereby storing each of said at least one of said plurality of push pins and said plurality of thumb tacks;

e) a pair of compartments disposed in a spaced apart relationship with each other on a curved peripheral side surface of said housing, each of said pair of compartments having an open top when said housing member is supported for use on a substantially hollow base member;

f) at least one additional compartment disposed at least one of within and on said housing member;

g) a tape dispenser disposed on said housing; and h) said substantially hollow base member having spaced-apart top and bottom planar portions forming open front and back portions, said base member is so disposed on said peripheral side surface of said housing member such that said housing member is supported and elevated above base member during use.

* * * * *